US006264175B1

(12) United States Patent
Wang

(10) Patent No.: US 6,264,175 B1
(45) Date of Patent: Jul. 24, 2001

(54) AUTOMATIC ADJUSTMENT CARBURETOR OFFERING FUEL ECONOMY AND LOW POLLUTION

(76) Inventor: Ming Ching Wang, No. 45, Alley 7, Lane 170, Tung Hsin St., Nan Kang Dist., Taipei (TW)

( * ) Notice: Subject to any disclaimer, the term of this patent is extended or adjusted under 35 U.S.C. 154(b) by 0 days.

(21) Appl. No.: 09/440,661

(22) Filed: Nov. 16, 1999

(51) Int. Cl.[7] ..... F02M 9/12
(52) U.S. Cl. ..... 261/44.5; 261/64.4
(58) Field of Search ..... 261/44.3, 44.4, 261/44.5, 44.9, 64.1, 40, 64.3, 64.4, DIG. 57, DIG. 61, DIG. 62, DIG. 63, DIG. 64

(56) References Cited

U.S. PATENT DOCUMENTS

| | | | | |
|---|---|---|---|---|
| 1,212,986 | * | 1/1917 | Moore | 261/44.5 X |
| 1,726,324 | * | 8/1929 | Udale | 261/44.5 X |
| 1,813,866 | * | 7/1931 | Royce | 261/44.5 |
| 1,934,240 | * | 11/1933 | Scott | 261/44.5 X |
| 2,016,449 | * | 10/1935 | Moysard | 261/DIG. 63 |
| 2,167,892 | * | 8/1939 | Kent et al. | 261/44.5 |
| 2,544,111 | * | 3/1951 | Schneebeli | 261/44.5 |
| 4,118,444 | * | 10/1978 | Abbey | 261/44.5 X |
| 4,132,752 | * | 1/1979 | Petermann | 261/44.5 X |
| 4,670,195 | * | 6/1987 | Robson | 261/44.5 X |
| 4,955,349 | * | 9/1990 | Feldinger | 261/44.5 X |
| 5,029,564 | * | 7/1991 | Neutzer | 261/44.5 X |
| 5,874,028 | * | 2/1999 | Liang et al. | 261/44.4 |

* cited by examiner

*Primary Examiner*—Richard L. Chiesa
(74) *Attorney, Agent, or Firm*—Rosenberg, Klein & Lee

(57) ABSTRACT

The present invention provides an automatic adjustment carburetor capable of offering fuel economy and low pollution, wherein an automatic adjustment air-blocking device and a gas enrichment device are appended in the intake passage of the carburetor. The air-blocking device is disposed in the intake passage in front of a throttle having a fuel needle. The middle section of the intake passage forms a room having a neck. A venturi tubular front part of expanding arc shape was formed extendedly forward from the neck in the intake passage. A rear part of pot belly shape was formed extendedly backward from the neck in the intake passage. An annular groove at the outer end of the intake passage joins an intake annular seat. A positioning shaft has a plurality of positioning grooves installed near two ends thereof. One positioning groove on each end of the positioning shaft joins a locking spring. The front end of the positioning shaft extends into a central hole of the intake annular seat to join a thread screwed with a nut. An air-blocking cone lags the positioning shaft. The front end of the air-blocking cone sticks to the front locking spring. A spring seat with a diameter larger than that of the locking spring is installed at the rear end of the air-blocking cone to lag one end of a spring. The other end of the spring sticks to a protruding locking edge at the other end of the positioning shaft. If the throttle at the rear part generates a negative pressure, the air-blocking cone will reciprocate back and forth. An exit of an emulsifying tube of the gas enrichment device is installed connectedly to the neck. When the air-blocking cone moves backward, the room of the neck changes, and fuel gas adjusts automatically.

5 Claims, 4 Drawing Sheets

AUTOMATIC ADJUSTMENT CARBURETOR OFFERING FUEL ECONOMY AND LOW POLLUTION

FIELD OF THE INVENTION

The present invention relates to an automatic adjustment carburetor capable of offering fuel economy and low pollution, especially to a device using a set of simple equipment to achieve automatic air-blocking, horsepower adjustment, and gas enrichment. This device is used to match basic structure and functions of the conventional carburetor to acquire the effects of fuel economy and low pollution.

BACKGROUND OF THE INVENTION

In order to meet requirement of environmental protection, the problem of how to reduce discharge of hydrocarbon (HC), carbon monoxide (CO), and nitrogen oxide ($NO_x$) of cars and motorcycles is an imperative issue. The conventional carburetor is used to provide proper air/fuel mixing ratios to meet the requirement of the engine at different rotation speeds. While much research has been managed, the problem of how to achieve optimal fuel consumption yet not deteriorate the engine performance is not fully solved. The conventional carburetor generally consumes more fuel to pay for the maintenance of the horsepower. Therefore, more than required fuel is consumed and the exhaust gas results in a more serious problem of air pollution.

Other researchers try to use a cam transmission mechanism for control, but the transmission mechanism is complicated while achieved control is limited.

SUMMARY AND OBJECTIVES OF THE PRESENT INVENTION

Accordingly, the objective of the present invention is to provide an automatic adjustment carburetor capable of offering fuel economy and low pollution, which provides fuel at the most economic condition yet does not influence the horsepower. Total combustion can be achieved to increase efficiency and save fuel, and the exhaust gas generates least pollution under any condition. Moreover, the present invention adopts the principle of negative pressure using a set of simple equipment to achieve the effect of automatic adjustment. Advantages of fuel economy, large horsepower, low pollution, low cost, and high efficiency are all acquired at the same time.

An automatic adjustment air-blocking device and a gas enrichment device are appended in the intake passage of the carburetor according to the present invention. The air-blocking device is disposed in the intake passage in front of a throttle having a fuel needle. The middle section of the intake passage forms a room with a neck. A venturi tubular front part of expanding arc shape was formed extendedly forward from the neck in the intake passage. A rear part of pot belly shape was formed extendedly backward from the neck in the intake passage. An annular groove at the outer end of the intake passage joins an intake annular seat. A positioning shaft has a plurality of positioning grooves installed near two ends thereof. One positioning groove on each end of the positioning shaft joins a locking spring. The front end of the positioning shaft extends into a central hole of the intake annular seat to join a thread screwed with a nut. An air-blocking cone lags the positioning shaft. The front end of the air-blocking cone sticks to the front locking spring. A spring seat with a diameter larger than that of the locking spring is installed at the rear end of the air-blocking cone to lag one end of a spring. The other end of the spring sticks to a protruding locking edge at the other end of the positioning shaft. If the throttle at the rear part generates a negative pressure, the air-blocking cone will reciprocate back and forth. An exit of an emulsifying tube of the gas enrichment device is installed connectedly to the neck. When the air-blocking cone moves backward, the room of the neck changes, and fuel gas adjusts automatically.

The various objects and advantages of the present invention will be more readily understood from the following detailed description when read in conjunction with the appended drawings, in which:

DETAILED DESCRIPTION OF PREFERRED EMBODIMENT

Figure 1:
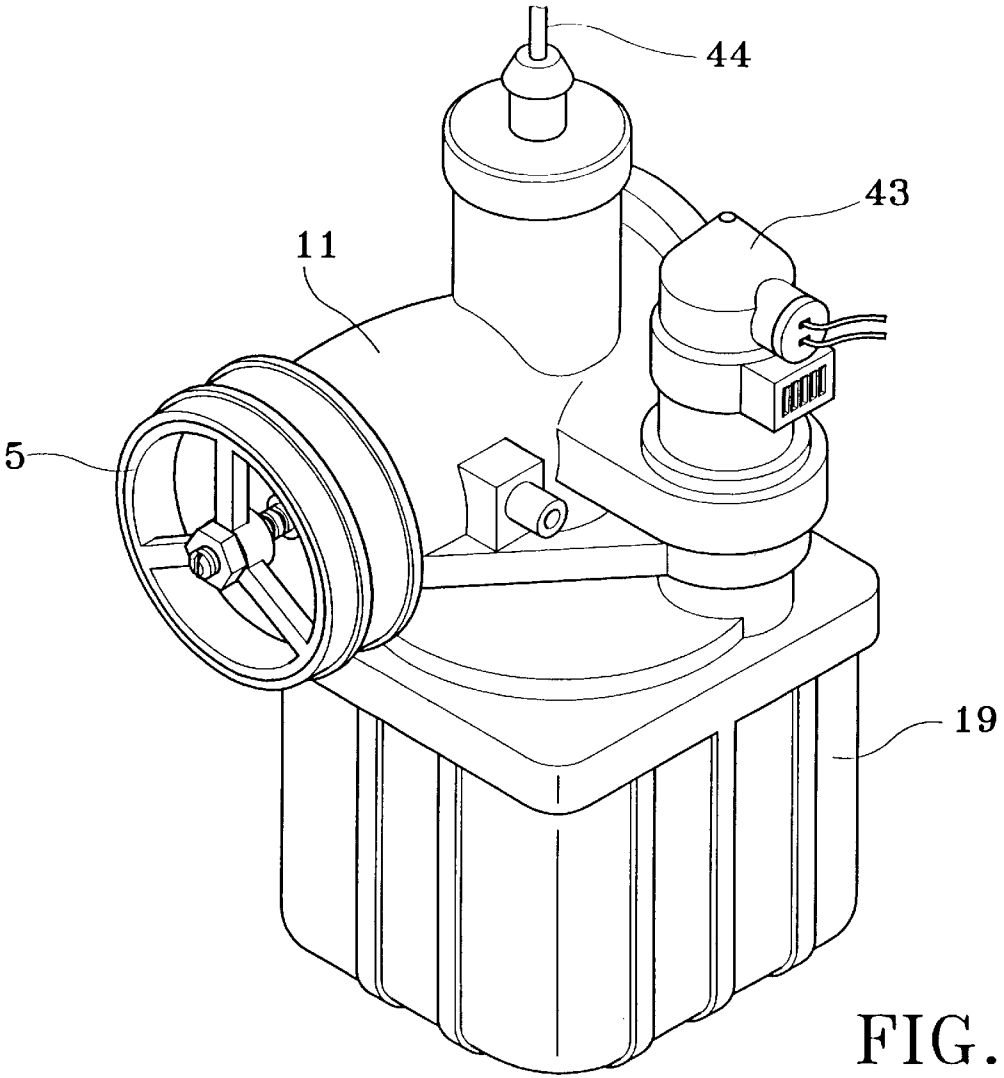
FIG. 1 is a perspective view of the automatic adjustment carburetor according to an embodiment of the present invention.
Figure 2:
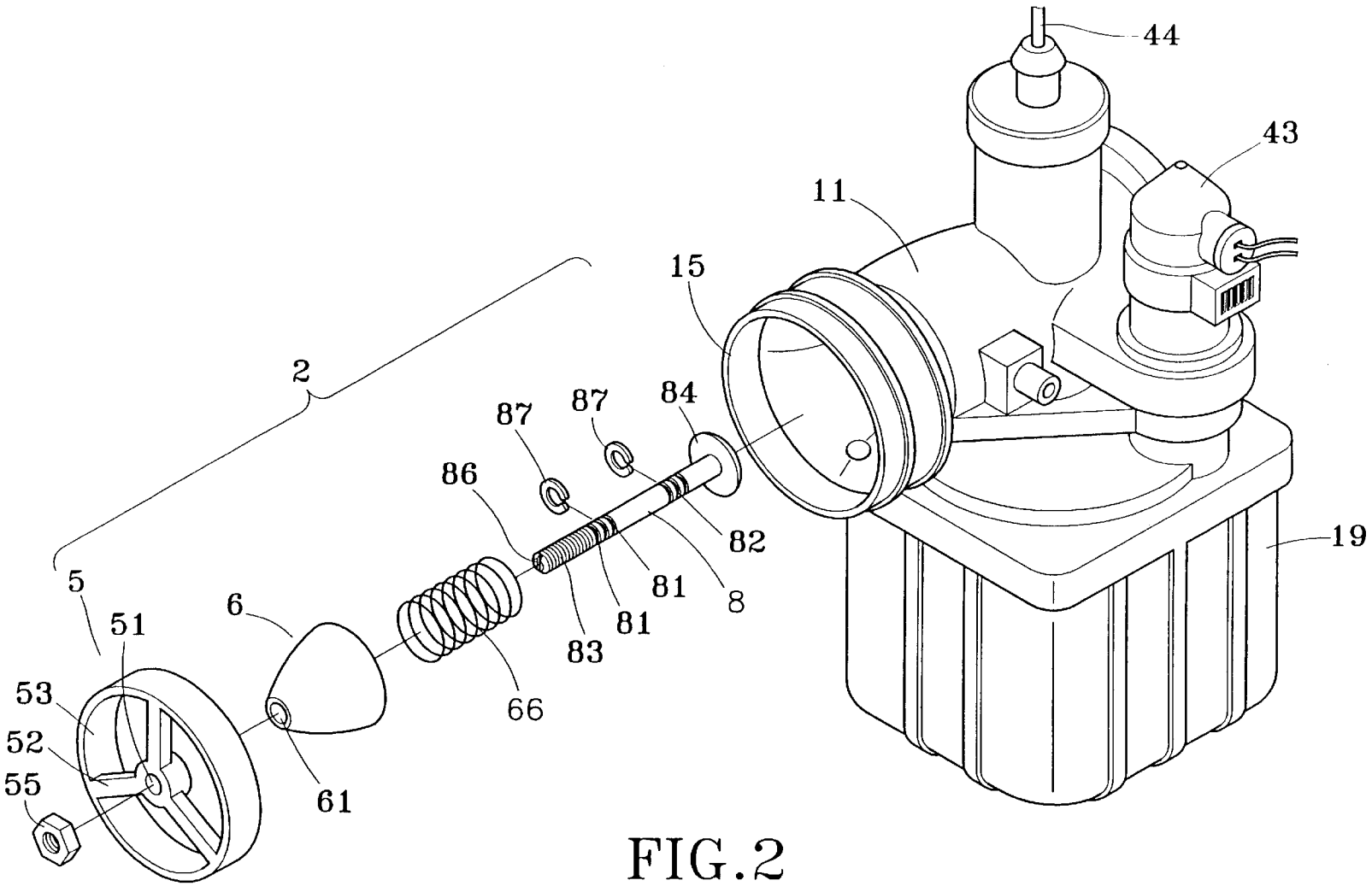
FIG. 2 is an exploded perspective view of the automatic adjustment carburetor according to an embodiment of the present invention.
Figure 3:
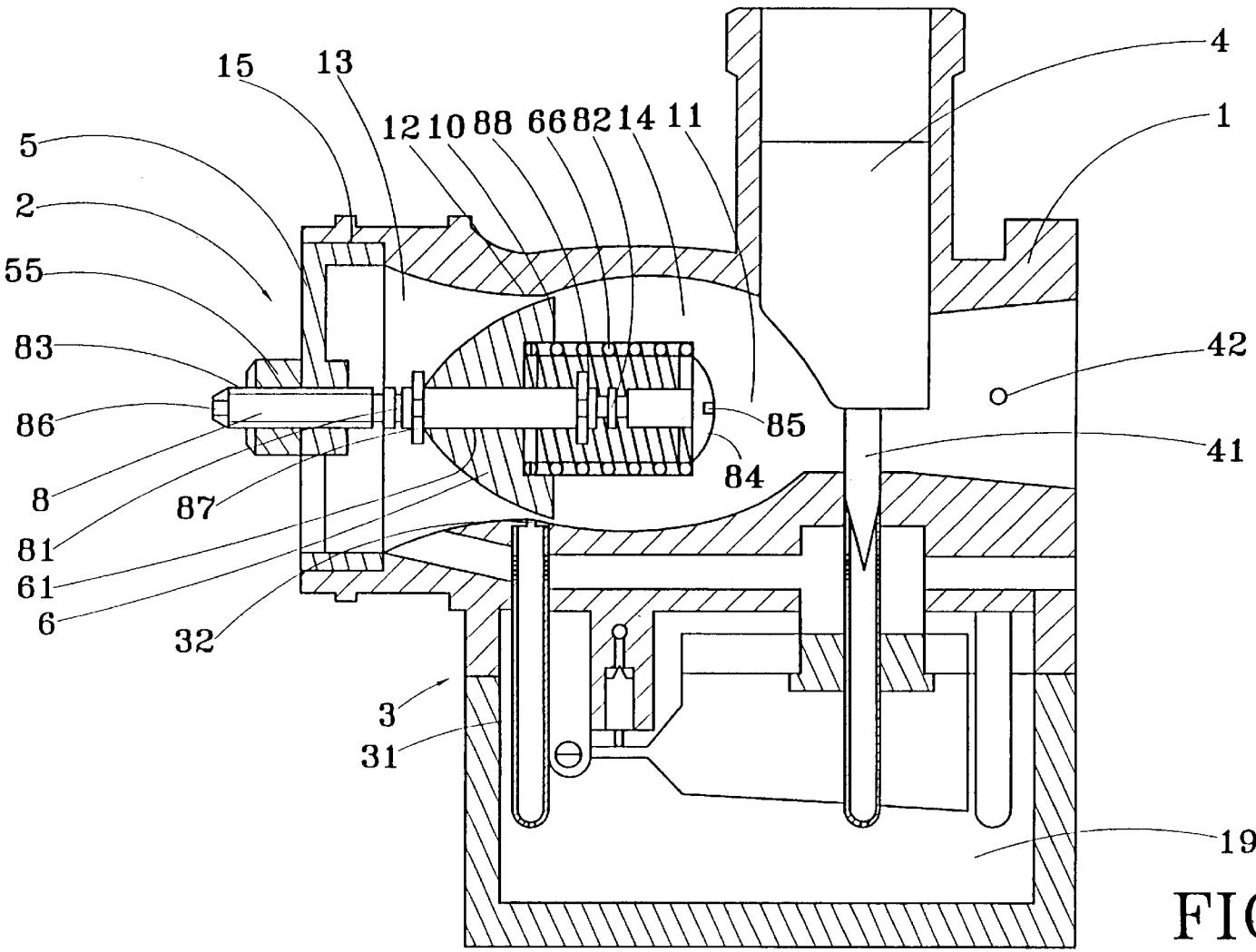
FIG. 3 is an assembly cross-sectional View of the automatic adjustment carburetor according to an embodiment of the present invention.

As shown in FIGS. 1 to 3, an automatic adjustment air-blocking device 2 and a gas enrichment device 3 are appended in the intake passage 11 of the main body 1 of the carburetor according to the present invention. The air-blocking device 2 is disposed in the intake passage 11 in front of a throttle 4 having a fuel needle 41. The middle section of the intake passage 11 forms a room 10 with a neck 12. A venturi tubular front part 13 of expanding arc shape was formed extendedly forward from the neck in the intake passage 11. A rear part 14 of pot belly shape was formed extendedly backward from the neck 12 in the intake passage 11. An annular groove 15 at the outer end of the intake passage 11 of the main body 1 joins an intake annular seat 5. The intake annular seat is of wheel shape. A rib 52 connects an annular edge 53 to a central hole 51 of the intake annular seat 5. The aperture between them is a ventilation channel to let air in through a filter. A positioning shaft 8 has a plurality of positioning grooves 81 and 82 is installed near two ends thereof. One positioning groove 81 (or 82) on each end of the positioning shaft 8 joins a locking spring 87 (or 88). The front end of the positioning shaft 8 extends into the central hole 51 of the intake annular seat 5 to join a thread 83 screwed with a nut 55. An air-blocking cone 6 lags the positioning shaft via a through hole 61. The front end of the air-blocking cone 6 sticks to the front locking spring 87. A spring seat 62 with a diameter larger than that of the locking spring 88 is installed at the rear end of the air-blocking cone 6 to lag one end 67 of a spring 66. The other end 68 of the spring 66 sticks to a protruding locking edge 84 at the other end of the positioning shaft 8. The thinner end of the air-blocking cone 6 adjoins the locking spring 87, and the thicker end of the air-blocking cone 6 can seal the room 10 formed by the neck 12. If the throttle 4 at the rear part generates a negative pressure, the air-blocking cone 6 will reciprocate back and forth between the bottom of the spring seat 62 thereof and the rear locking spring 88. An exit 32 of an emulsifying tube 32 of the gas enrichment device 3 is installed connectedly to the neck 12. When the air-blocking cone 6 moves backward, the room 10 of the neck 12 emerges, and fuel gas automatically moves out of the exit to replenish. An inner adjusting groove 85 and an outer adjusting groove 86 are respectively installed at the inner and outer ends of the positioning shaft 6.

The present invention further comprises the main body, a float-feed chamber 19, a cold starting compensation device 43, a fuel line 44, and a throttle 4 of the conventional carburetor to match the air-blocking device 2. Automatic air-blocking and horsepower adjustment are achieved by using the air-blocking cone 6. The throttle and fuel circuit of the conventional carburetor are adopted to meet the air/fuel mixing requirement. Also, the art of the cold starting compensation device 43 and the idle fuel circuit 42 can be adopted.

Figure 4:
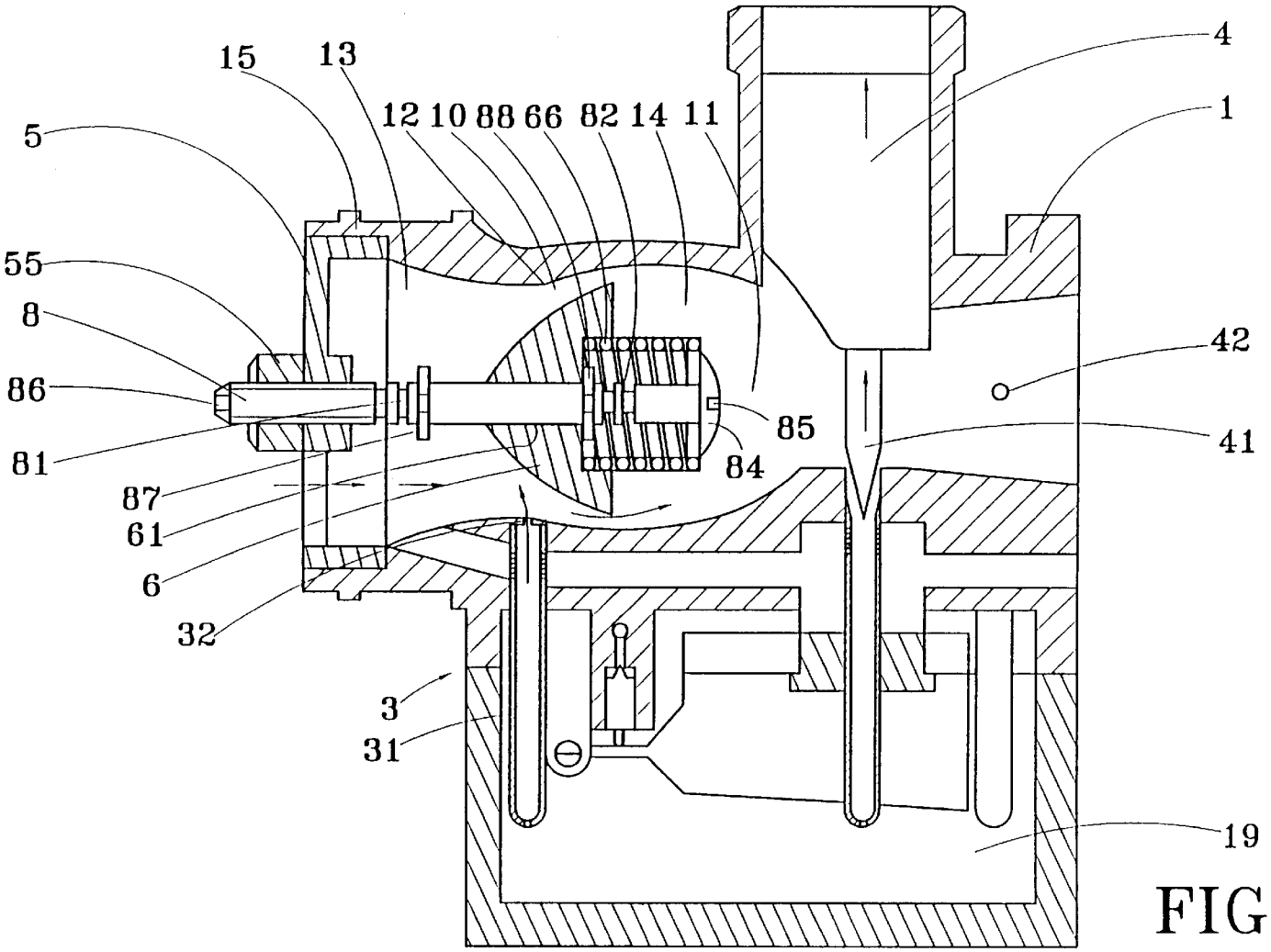
FIG. 4 is an assembly cross-sectional view of the automatic adjustment carburetor during action according to an embodiment of the present invention.

When the fuel line 44 is used for acceleration, the throttle 4 opens, and meanwhile the suction force of the engine increases to suck the air-blocking cone 6 backward and to generate a relative locomotion just as the states shown in FIGS. 3 to 4. The room of the intake passage 11 changes to provide more air flow for achieving the best air/fuel mixing ratio. When the suction force of the engine decreases or the horsepower is insufficient, the air-blocking cone 6 will automatically move forward to a predetermined position of the neck 12 to perform the air-blocking function and let the incoming air decrease. The objectives of automatic air-blocking and gas enrichment are then achieved. When the engine restores to its normal condition, the air-blocking cone 6 will restore backward to its original position to provide the best air/fuel mixing ratio, resulting in fuel economy and low pollution.

The effective sliding distance of the air-blocking cone 6 when moving forward and backward according to the vacuum suction force of the engine is controlled by the front and rear locking springs at two ends of the positioning shaft. Because adjustment of the positions of the locking springs changes the sliding distance of two ends, it is set according to the practical requirement of acceleration function of the engine. The positions of the locking springs are generally set in the car factory after checking and the inner adjusting groove is tuned when assembled to set the best position of the positioning shaft. Only the outer adjusting groove of the positioning shaft can be screwably adjusted when used.

Moreover, a fuel circuit of the gas enrichment device 3 is appended at the bottom surface of the neck to match the corresponding position of the air-blocking cone for providing proper functions of gas enrichment and compensation. For instance, when the car accelerates hastily moves uphill, or the function of the engine decreases, the gap in front of the neck a narrows. Meanwhile, when the negative pressure increases, the exit 32 at the neck automatically increases the effusion of the fuel gas, achieving the objective of gas enrichment and horsepower adjustment. Therefore, the curvature of the outer shape of the air-blocking cone is very important. The curvature of the outer shape of the air-blocking cone can be changed to control the air/fuel mixing ratios for different rotation speeds of the engine. The effective curvature of the outer shape of the air-blocking cone can be determined by experiments or actual measurements.

The thinner the air/fuel mixing ratio, the more economic the engine. But too thin an air/fuel ratio will reduce the horsepower and deteriorate the engine function. The present invention uses the negative pressure to automatically move the air-blocking cone of the air-blocking device for controlling the air flow and thus changing the air/fuel ratio. If the fuel gas is insufficient, the gas enrichment device can replenish. Whether the best combustion condition is achieved can be judged according to the exhaust gas at different rotation speeds of the engine and the quantity of consumed fuel under the same load condition. Therefore, the present invention really provides an automatic carburetor capable of offering fuel economy and low pollution.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. An automatic adjustment carburetor capable of offering fuel economy and low pollution, wherein an automatic adjustment air-blocking device and a gas enrichment device are appended in an intake passage of said carburetor, said air-blocking device being disposed in said intake passage in front of a throttle having a fuel needle, said air-blocking device comprising a positioning shaft, an intake annular seat, a pair of locking springs, an air-blocking cone, and a spring, the middle section of said intake passage forming a room having a neck, a venturi tubular front part of expanding arc shape was formed extendedly forward from the neck in the intake passage, a rear part of pot belly shape was formed extendedly backward from the neck in the intake passage, an annular groove at the outer end of said intake passage joining said intake annular seat, said positioning shaft having a plurality of positioning grooves being installed near two ends thereof, one said positioning groove on each end of said positioning shaft joining said locking spring, the front end of said positioning shaft extending into a central hole of said intake annular seat to form a thread screwed with a nut, said air-blocking cone lagging said positioning shaft, the front end of said air-blocking cone sticking to said front locking spring, said spring seat with a diameter larger than that of said locking spring being installed at the rear end of said air-blocking cone to lag one end of said spring, the other end of said spring sticking to a protruding locking edge at the other end of said positioning shaft;

whereby if said throttle at the rear part generates a negative pressure, said air-blocking cone will automatically reciprocate back and forth.

2. The automatic adjustment carburetor capable of offering fuel economy and low pollution of claim 1, wherein a gas enrichment device is further installed connectedly to said neck, said gas enrichment device having an emulsifying tube, an exit of said emulsifying tube disposed at said neck, the other end of said emulsifying tube connected to a fuel-supplying device;

whereby when said air-blocking cone moves backward, said room of said neck emerges, and fuel gas automatically replenishes.

3. The automatic adjustment carburetor capable of offering fuel economy and low pollution of claim 1, wherein the front end of said positioning shaft extends forward through a screw hole at the central hole of said intake annular seat to screw a nut.

4. The automatic adjustment carburetor capable of offering fuel economy and low pollution of claim 1, wherein each end of said positioning shaft has an adjusting groove.

5. The automatic adjustment carburetor capable of offering fuel economy and low pollution of claim 1, wherein a rib connects an annular edge to the central hole of said intake annular seat, the aperture between them is a ventilation channel.

* * * * *